US006829790B2

(12) United States Patent
Petrovic et al.

(10) Patent No.: US 6,829,790 B2
(45) Date of Patent: Dec. 14, 2004

(54) ADD-ON MULTI-HEAD BODY SPRAY SHOWER

(75) Inventors: John Edward Petrovic, Hillsdale, MI (US); Todd Alex Talbot, Jackson, MI (US)

(73) Assignee: Alsons Corporation, Hillsdale, MI (US)

( * ) Notice: Subject to any disclaimer, the term of this patent is extended or adjusted under 35 U.S.C. 154(b) by 174 days.

(21) Appl. No.: 09/965,150

(22) Filed: Sep. 27, 2001

(65) Prior Publication Data

US 2003/0056286 A1 Mar. 27, 2003

(51) Int. Cl.[7] ..... A47K 3/22

(52) U.S. Cl. ..... 4/601

(58) Field of Search ..... 4/567–570, 601; 239/282

(56) References Cited

U.S. PATENT DOCUMENTS

| | | | | | |
|---|---|---|---|---|---|
| 3,121,235 | A | * | 2/1964 | Gellmann | 4/601 X |
| 3,375,532 | A | * | 4/1968 | Gellman | 4/601 |
| 5,652,973 | A | * | 8/1997 | Blue | 4/570 |
| 5,692,252 | A | * | 12/1997 | Zwezdaryk | 4/601 |
| 6,233,756 | B1 | * | 5/2001 | Holbrook | 4/601 |

* cited by examiner

*Primary Examiner*—Charles E. Phillips
(74) *Attorney, Agent, or Firm*—John A. Artz; Artz & Artz

(57) ABSTRACT

A multiple head shower system particularly designed for retrofit installation on an existing shower system, and having a head member with a primary outlet and at least one secondary outlet, a primary shower head, at least one elongated water conduit, and at least one secondary on/off water valve member. The secondary valve members are secured to the shower enclosure with a bracket member and an adhesive. The header member is secured to the existing shower system with a threaded connection or a slip-fit connection. Preferably, a pair of secondary on/off water valve members and conduits are provided.

5 Claims, 3 Drawing Sheets

ADD-ON MULTI-HEAD BODY SPRAY SHOWER

TECHNICAL FIELD

The present invention relates to shower systems with multiple shower heads.

BACKGROUND OF THE INVENTION

There are several shower systems known today which utilize multiple shower heads. Most of these systems, however, are either expensive or complicated to use and install. Also, most of them are installed as part of the original plumbing system.

There is a need for an inexpensive, easy-to-use, multiple shower head system which can be retrofitted on existing plumbing systems.

SUMMARY OF THE INVENTION

It is an object of the present invention to provide an improved shower system with multiple shower heads. It is also an object of the present invention to provide a multiple head shower system which can be retrofitted on existing plumbing systems.

It is a further object of the present invention to provide a multiple head shower system which is inexpensive and easy to install and use. It is a still further object of the present invention to provide a multiple head shower system which can be retrofitted on existing plumbing systems and which utilizes unique attachment and connector mechanisms, both for the primary shower head and the secondary spray valve mechanisms.

The present invention fulfills these objectives and provides a unique and beneficial multiple head shower system which is inexpensive, easy to install, and can be retrofitted on existing plumbing systems. In accordance with the present invention, the system utilizes a connector head mechanism for connecting the primary shower head with the existing plumbing system, a pair of conduit or pipes which direct the spray to two secondary locations, a pair of secondary valve mechanisms attached to the end of the conduits, and bracket mechanisms for attaching the secondary valve mechanisms to the wall of the shower enclosure. The main connector member includes a unique header member which can be screwed on or, in an alternative embodiment, slipped on an intervening connector pipe to the original plumbing system. The header member has a main outlet for attachment to the primary shower head, and two secondary outlets for attachment to the secondary conduits and spray valve mechanisms. The secondary conduits are preferably rigid metal tubing and are used to convey the water to the secondary valve mechanisms. Each of the secondary valve mechanisms are attached by a bracket member or the like to the wall of the shower enclosure using adhesive pads or the like. Each of the secondary valve mechanisms include individual shut-off mechanisms. Also, the secondary valve mechanisms have spray jets which can be rotated in order to direct the water spray as desired.

Further features and benefits of the present invention will become apparent from a review of the accompanying disclosure when viewed in accordance with the attached drawings and appended claims.

DESCRIPTION OF THE PREFERRED EMBODIMENT(S)

Figure 1:
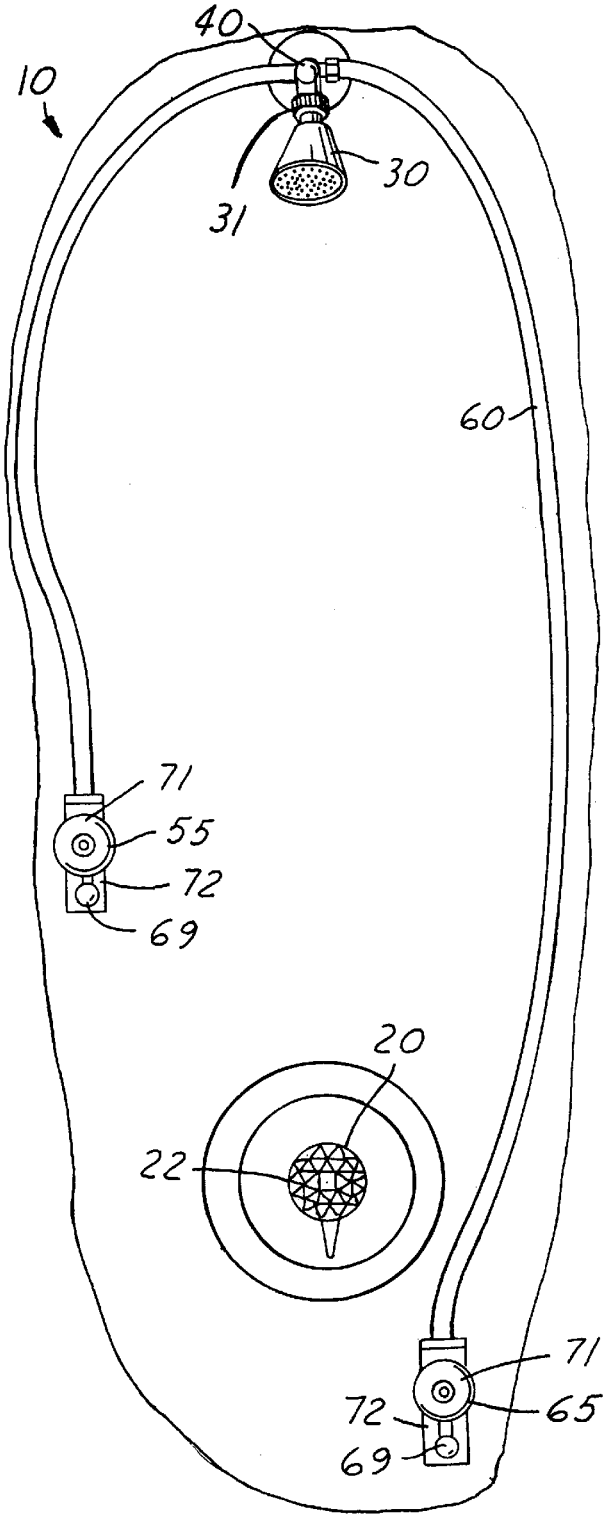
FIG. 1 is a schematic illustration of the present invention.
Figure 2:
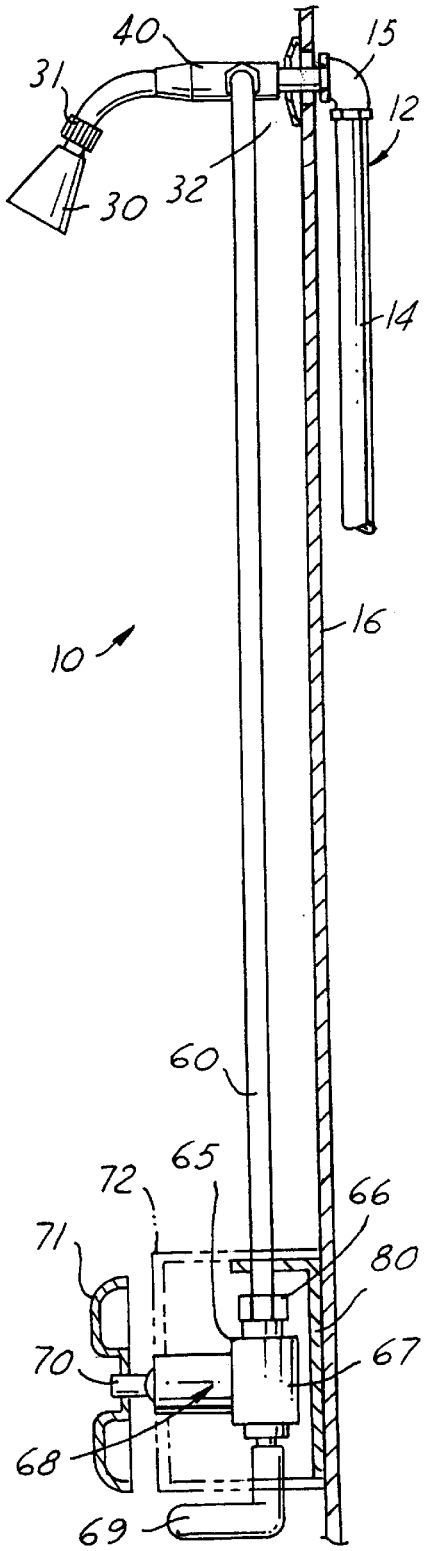
FIG. 2 is a side view in partial cross-section illustrating installation of the present invention.

The shower system in accordance with the present invention is schematically illustrated in FIGS. 1 and 2 and generally referred to by the reference numeral 10. The unique system 10 is particularly adapted to be retrofitted upon an existing shower or plumbing system generally referred to by the reference numeral 12.

As shown, the existing plumbing system 12 includes a main water conduit 14 which is typically positioned behind the wall of a shower enclosure 16. As is typical with shower enclosures, the shower enclosure wall 16 can be made of a fiberglass preform material or covered with ceramic tile or the like (not shown). The primary shower plumbing system 12 also typically includes a primary on/off shut-off valve mechanism 20 (shown in FIG. 1). The mechanism 12 typically includes a knob mechanism 22 which is attached to a valve mechanism (not shown), which turns off and on the flow of water to the main water conduit 14 and in turn to the primary shower head member 30.

The primary water conduit 14 also has an elbow member 15 which is positioned to be connected to the primary shower head 30 through an opening 28 in the wall of the shower enclosure 16. An intervening connector pipe member 32 is typically utilized to connect the main conduit member 14 to the primary shower head member 30.

In accordance with the system 10 of the present invention, a unique header member 40 is utilized. The system 10 also includes a pair of water conduit members 50 and 60, together with secondary shower water valve mechanisms 55 and 65.

Figure 3:
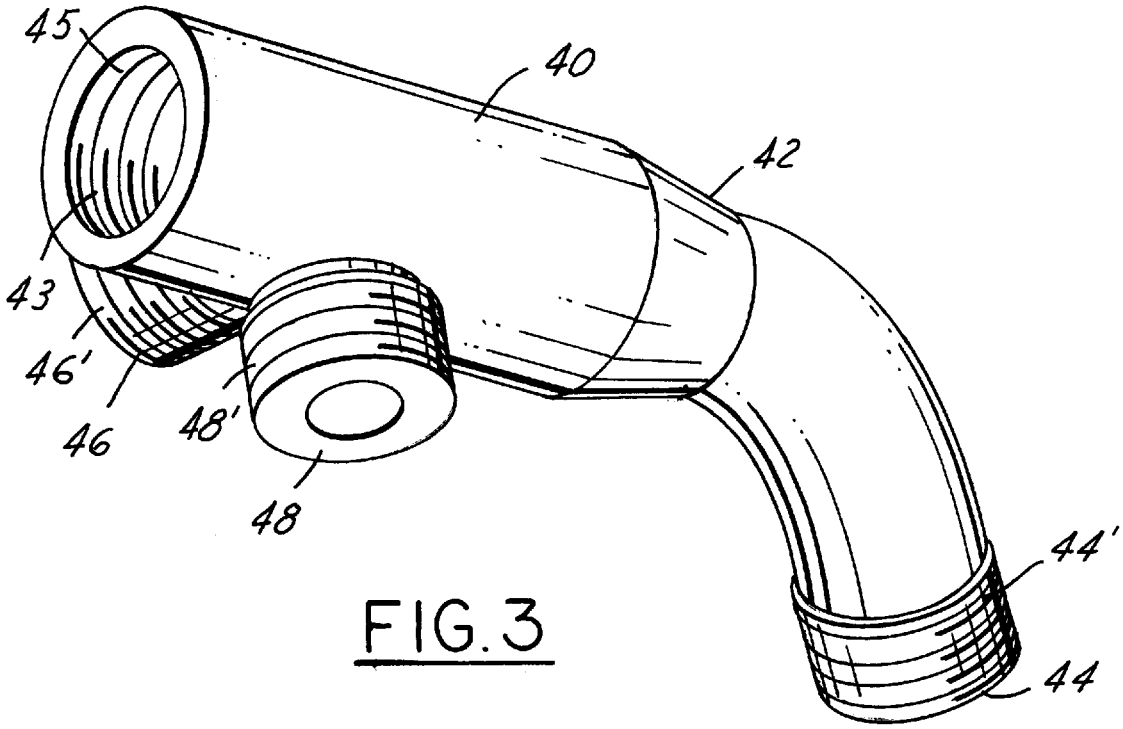
FIG. 3 is a perspective view of a unique header member which can be utilized with the present invention.

The header member 40 is better shown in FIG. 3. The header member has an elongated body member 42 having water inlet port 43 at one end and a water outlet port 44 at the other end. The outlet 44 is adapted to be connected to the main shower head member 30. The header member 40 also has a pair of secondary water outlet ports 46 and 48 which are adapted to be connected to the conduits 50 and 60 and in turn to the secondary shower head members 55 and 65. As shown in FIG. 3, the main water inlet 43 has a plurality of internal threads 45 which are used to threadedly connect the header member 40 to the main water conduit 14 and/or connector pipe member 32.

The three outlets 44, 46 and 48 also have external threaded mechanisms 44', 46', and 48' for being threadedly connected to the primary shower head 30 and the secondary conduit members 50 and 60, respectively. The header member 40 can be made of any appropriate material, but preferably is made of a metal material and plated with a chrome material.

The main shower head member 30 is adapted to be connected to the header member 40 by a conventional threaded ball joint nut mechanism 31. Also, a gasket or other sealing member is typically utilized to connect the primary shower head member 30 to the header member 40 in order to prevent water leakage.

The primary shower head member 30 can be of any conventional type, such as that shown in U.S. Design Pat. No. 435,889. The disclosure of which is hereby incorporated herein by reference.

The two secondary water conduits 50 and 60 are preferably of different lengths, as shown in FIG. 1. This allows positioning of the secondary shower head members 55 and 65 at different locations relative to the user's body. Preferably, the conduit members 50 and 60 are made of a metal pipe material plated with a chrome material. Of course, it is understood that the conduit members can be made of any other appropriate material conventionally used for shower systems today.

Figure 4:
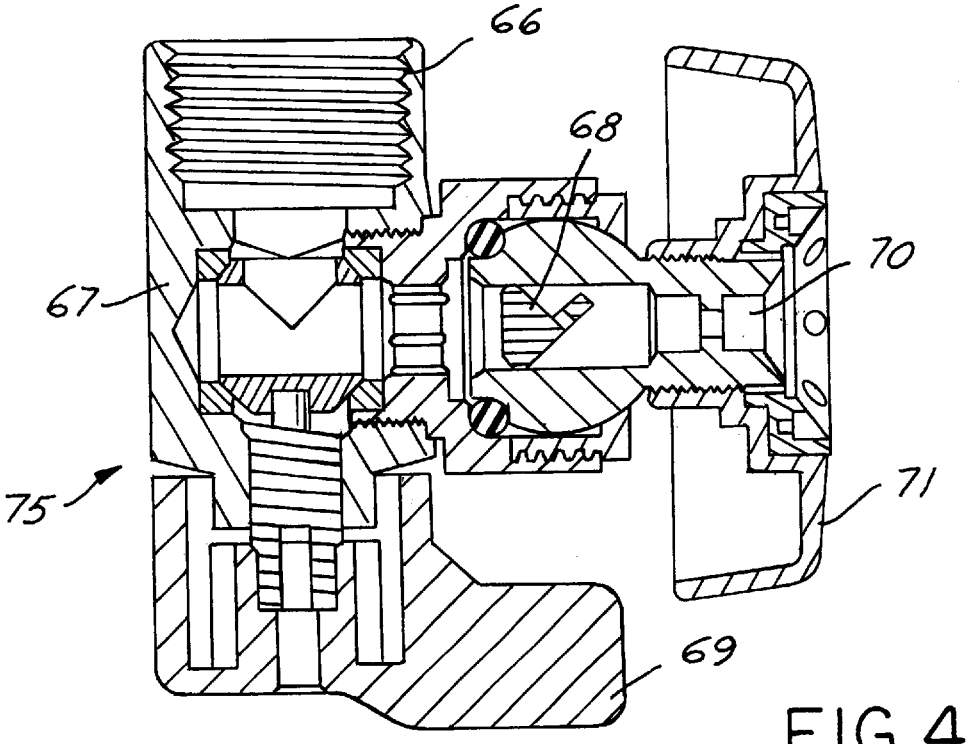
FIG. 4 is a cross-sectional view of a secondary valve mechanism.

The secondary spray valve mechanisms 55 and 65 can be of any conventional type and are shown schematically in FIGS. 1 and 2. A preferred valve mechanism which can be used with the present invention is shown in FIG. 4 and referred to by the reference numeral 75.

As shown schematically in FIGS. 1 and 2, each of the secondary shower head mechanisms 55 and 65 include a connector member 66, a main body member 67, an internal valve mechanism 68, a on/off handle or lever member 69, a water outlet member 70, and an outer cowling 71 positioned around the water outlet or spray jet member 70. It is also possible to have an optional housing member 72 which is positioned around the valve members 55 and 65 in order to enclose it and make it more aesthetically attractive.

Preferably, the position of the jet spray of water exiting from the spray jet member 70 is adjustable. For example, the water spray can be rotated on the order of 40° in order to direct the spray as desired by the user. Spray nozzle mechanisms of this type which can be utilized for the present invention are preferably nozzles where the spray causes a tangential action in the water jet just prior to exiting from the spray orifice.

Figure 5:
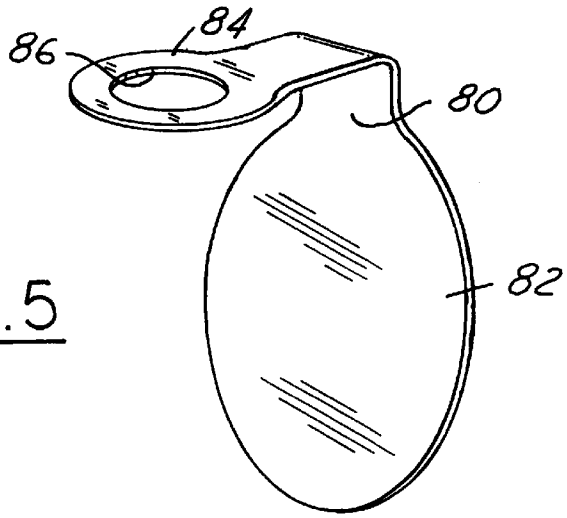
FIG. 5 is a perspective view of a bracket member for use with the present invention.

Each of the secondary shower head members 55 and 65 are attached to the wall of the shower enclosure 16 by a bracket member 80. In this regard, a preferred bracket member 80 is shown schematically in FIG. 5. The bracket member 80 includes a main body portion 82 which is flat and adapted to be attached flush with the surface of the wall of the shower enclosure 16. The bracket member 80 also includes a second portion 84 which is essentially positioned at right angles to the main body portion 82 and includes an opening 86 which is adapted to be positioned around the conduit members 50 and 60.

The bracket member 80 is preferably made of a metal material, such as stainless steel and preferably attached to the wall of the shower enclosure 16 by an adhesive material, such as an adhesive pad or the like. The bracket can be highly polished or plated to provide a cosmetic appealing look.

Figure 6:
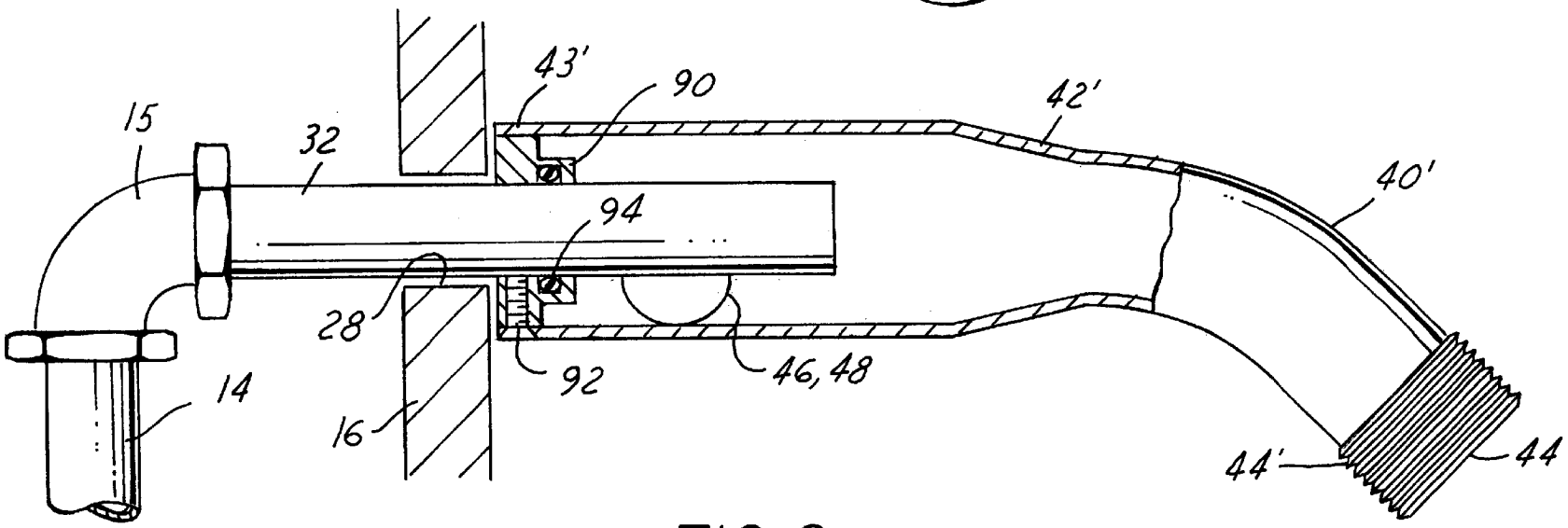
FIG. 6 illustrates an alternate embodiment of a header member for use with the present invention.

An alternate header member 40' is shown in FIG. 6. Header member 40' is adapted to be slipped onto the existing shower plumbing installation and then secured in place. As indicated, the inlet end 43' of the header member 40' is positioned over the connector pipe member 32 which in turn is attached to the primary water conduit 14. An insert member 90 is positioned at the inlet end 43' of the header member 40' and is adapted to be connected over the connector member 32 in a slip-fit relationship. A screw member 92 is positioned to securely attach the header member 40' to the connector member 32 and in turn to the primary water conduit 14. A sealing member, such as O-ring 94, or the like is utilized to sealingly connect the header member 40' to the primary plumbing installation and prevent water leakage.

Although the present invention is described above with reference to having a pair of secondary shower head mechanisms, it is understood that the present inventive multi-head shower system is not limited to that precise number of head members. For example, the shower system can utilize only a single secondary shower head member, or three or more shower head members. It would be within the ordinary skill of persons in the art in order to adapt the present inventive system as described above to systems having only one, or three or more secondary shower head mechanisms.

While particular embodiments of the invention have been shown and described, numerous variations and alternative embodiments will occur to those skilled in the art. Accordingly, it is intended that the invention be limited only in terms of the appended claims.

What is claimed is:

1. A multiple head shower system for retrofit installation on an existing shower plumbing system in a shower enclosure, the shower enclosure having a vertical wall extending upwardly from a tub or base, said existing shower plumbing system having a primary water conduit extending to a position on the vertical wall of the shower enclosure substantially above the tub or base and a primary water on-off valve mechanism located in the shower enclosure for turning on and off the source of water to the primary water conduit, said multiple head shower system comprising:

a header member for connection to said primary water conduit, said header member extending from the vertical wall of the shower enclosure and having a primary shower head outlet and a pair of secondary shower head outlets;

an intervening pipe member positioned and threadedly secured between said header member and said primary water conduit;

a primary shower head attached to said primary shower head outlet on said header member;

a first elongated water conduit attached to a first of said pair of secondary shower head outlets, said first elongated water conduit extending vertically downwardly in a direction toward the tub or base;

a second elongated water conduit attached to the second of said pair of secondary shower head outlets, said second elongated water conduit extending vertically downwardly in a direction toward the tub or base;

both of said first and second water conduits extending a substantial distance downwardly toward said tub or base and said first and second water conduits extending downwardly in different amounts;

a first secondary water spray valve mechanism attached to the end of the first of said water conduits and having a separate on-off lever member; and a second secondary water spray valve mechanism attached to the end of the second of said water conduits and having a separate on-off lever member.

2. The multiple head shower system as described in claim 1 further comprising a bracket member attached to each of said secondary valve members for attaching said secondary valve members to the shower enclosure.

3. The multiple head shower system as described in claim 2 wherein said bracket member has a substantially L-shape.

4. The multiple head shower system as described in claim 2 wherein said bracket member is attached to the shower enclosure with an adhesive material.

5. The multiple head shower system as described in claim 1 wherein said header member is threadedly connected to said primary water conduit.

* * * * *